United States Patent [19]

Campbell et al.

[11] Patent Number: 4,823,467

[45] Date of Patent: Apr. 25, 1989

[54] SERRATED-EDGE KNIVES

[75] Inventors: Barrie M. Campbell, Bamford; Dennis Spooner, Sheffield, both of United Kingdom

[73] Assignee: Walter Lawrence Manufacturing Limited, Sawbridgeworth, United Kingdom

[21] Appl. No.: 139,021

[22] Filed: Dec. 29, 1987

[30] Foreign Application Priority Data

Jan. 5, 1987 [GB] United Kingdom ..... 8700062

[51] Int. Cl.[4] ..... B26B 9/02

[52] U.S. Cl. ..... 30/355

[58] Field of Search ..... 30/355, 357, 346, 353; 83/661, 697

[56] References Cited

U.S. PATENT DOCUMENTS

| | | | |
|---|---|---|---|
| 2,059,414 | 11/1936 | Taylor | 30/355 |
| 3,024,533 | 3/1962 | Nitsch | 30/355 |

FOREIGN PATENT DOCUMENTS

| | | | |
|---|---|---|---|
| 391947 | 5/1933 | United Kingdom | 30/355 |
| 2108887 | 5/1983 | United Kingdom | 30/355 |
| 0220362 | 5/1987 | United Kingdom | 30/355 |

*Primary Examiner*—Frank T. Yost
*Assistant Examiner*—Eugenia A. Jones
*Attorney, Agent, or Firm*—Cushman, Darby & Cushman

[57] ABSTRACT

A serrated-edge knife, the blade of which is provided on one side with a plurality of scallops and on its other side with a plurality of closely spaced serrations, the scallops intersecting the serrations to produce a fine saw-like edge substantially centrally of the thickness of the blade.

10 Claims, 3 Drawing Sheets

SERRATED-EDGE KNIVES

FIELD OF THE INVENTION

The invention relates to serrated-edge knives, that is to say bread, meat, fruit and other knives in which the cutting edge has been provided with grooves ground in one face so that the cutting edge has a fine saw-like appearance.

Various attempts have previously been made to produce a serrated-edge knife with an improved cutting action, that is to say which will cut cleanly rather than with the tearing action which has been characteristic of some serrated-edge knives. For example, a parallel-sided blade blank has been provided with serrations on one side only, the serrations intersecting the surface of the opposite face to produce a cutting edge in the plane of the unground surface. It is also known to produce a V-shaped cutting edge on a parallel-sided blade blank by flat grinding one side of the V and by grinding the other side of the V with formulations to form a cutting edge located substantially centrally of the thickness of the blank, the formulations being scallops and/or serrations. When the formulations referred to have been serrations, these have either been uniformly applied to the blade blank from end to end thereof or have been applied in groups of serrations of varying depth, the effect being that the finished blade has been provided with formulations which are scallops the surfaces of which are serrated. In all these cases, when the formulations have been constituted by or have included serrations the effect has been to produce a fine saw-like cutting edge. However, not all such knives have been of an attractive appearance and it has sometimes been found that such knives have cut with a tearing action rather than cleanly.

The invention has for its object to provide a form of serrated-edge knife which will cut cleanly rather than with a tearing action and which will have an improved appearance.

SUMMARY OF THE INVENTION

According to the invention, there is provided a serrated-edge knife the blade of which has been made from a parallel-sided blade blank, the blank having been provided on one side with a plurality of scallops and on its other side with a plurality of closely spaced serrations, the scallops intersecting the serrations at the cutting edge of the blade to produce a fine saw-like edge substantially centrally of the thickness of the blade. An end portion of the blade remote from the handle may be curved. The scallops on the one side of the blade may extend at right angles from the cutting edge along the entire length of the blade.

The included angle of the V-shaped cutting edge may lie between 12 degrees and 30 degrees, preferably between 16 degrees and 24 degrees and ideally between 18 degrees and 22 degrees.

The serrations may be ground at a pitch between 0.6 mm and 1.2 mm and ideally at a pitch of 0.8 mm.

The serrations may each have an included angle of between 45 degrees and 75 degrees and ideally of about 70 degrees.

DESCRIPTION OF THE PREFERRED EMBODIMENT

Figure 1:
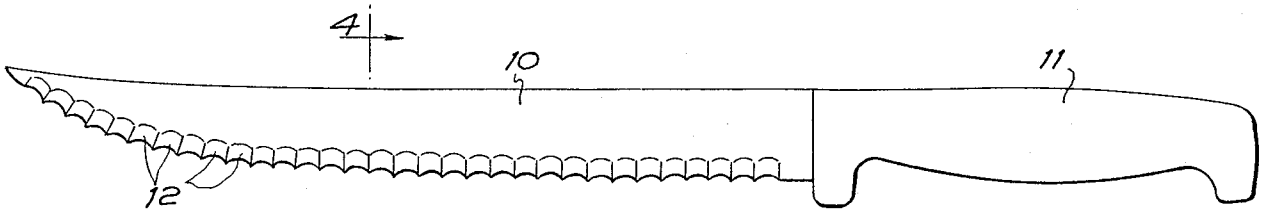
FIG. 1 is a view from one side of a bread knife embodying the invention.

Referring now to FIGS. 1 to 4 of the drawings, the bread knife there illustrated has a blade 10 and a handle 11. (In the illustrated embodiment the handle is made of a synthetic plastics material moulded on a tang portion, not shown, of the blade, but it will be understood that in fact any preferred kind of handle may be provided). The blade has been made from a parallel-sided blade blank and provided on one side (see FIG. 1) with a plurality of scallops 12. On its other side (see FIG. 2) the blade is provided with a plurality of closely spaced serrations 14. The serrations are spaced at approximately 0.8 mm pitch. The scallops are spaced at approximately 4 mm pitcfh. Thus is will be seen in FIG. 3 that whereas the greater part of each scallop surface is quite plain, the scallops intersect the serrations at the cutting edge of the blade to produce a fine saw-like edge substantially centrally to the thickness of the blade.

In this illustrated embodiment, an end portion of the blade remote from the handle is curved, as shown. However, it will be seen in FIG. 1 that the scallops on the one side of the blade extend at right angles from the cutting edge along the entire length of the blade.

Figure 4:
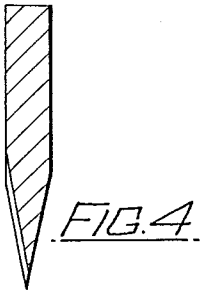
FIG. 4 is a section through the blade on the line 4—4 in FIG. 1, FIGS. 5 and 6 are diagrammatic views which will presently be referred to, and FIG. 7 is a view of a somewhat modified form of blade embodying the invention.
Figure 3:
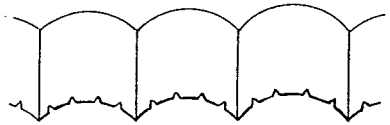
FIG. 3 is an enlarged view of a blade portion of the knife as viewed in FIG. 1.
Figure 5:
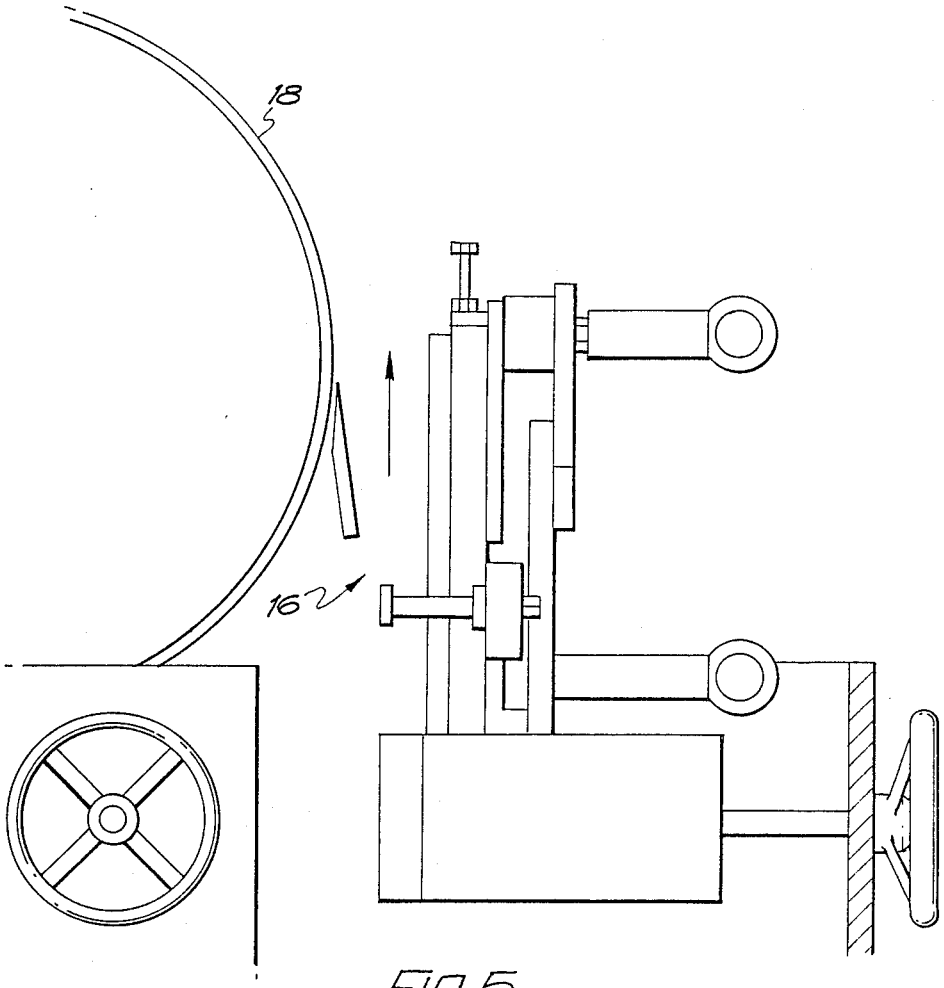
Figure 6:
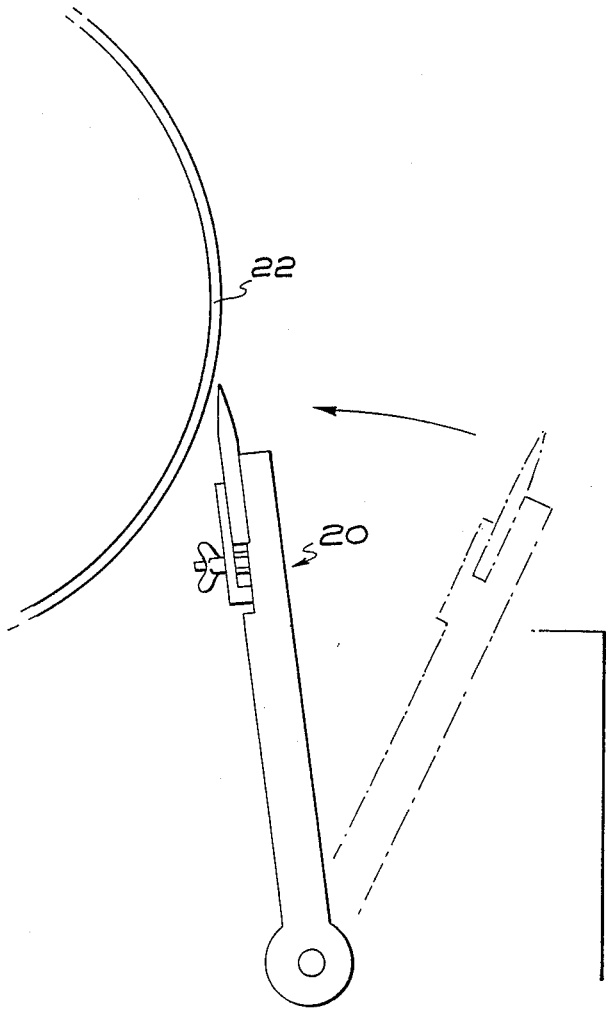

As shown in FIG. 4, the included angle of the V-shaped cutting edge lies between 18 degrees and 22 degrees. The scallops have been applied to the blade blank on a wave edge grinder as illustrated diagrammatically in FIG. 5, that is to say by mounting the blank in a holder 16 and sweeping it upwards into contact with a wavy edged grinding wheel 18. The serrations have been applied to the other side of the blade blank as illustrated diagrammatically in FIG. 6, that is to say by a conventional plunge grinding operation in which the blank is mounted on a holder 20 and pivoted into contact with a serrated edged grinding wheel 22. The included angle between adjacent serrations is between 45 degrees and 75 degrees, ideally of about 70 degrees.

It has been found that knife blades produced as described above exhibit a superior cutting action without the tearing action which has been characteristic of some other serrated-edge knives. However, since the grinding of the blades is carried out in a relatively simple manner, the blades are produced at relatively low cost.

Figure 2:
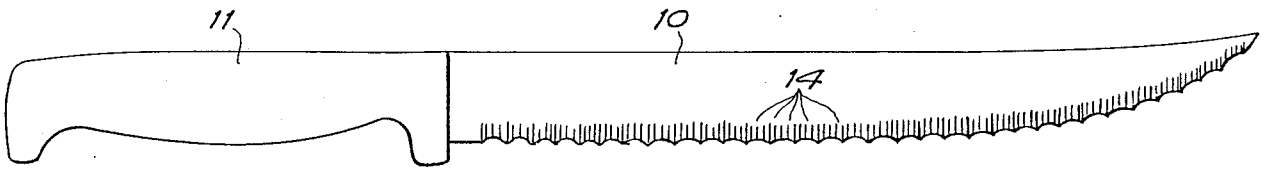
FIG. 2 is a view from the other side.
Figure 7:
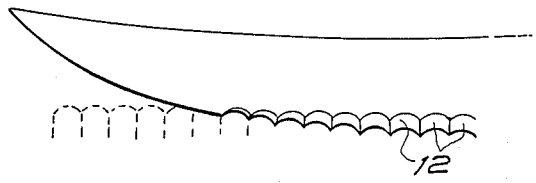

Various modifications may be made. For example, the provision of the scallops on one side and serrations on the other side of the blade could be carried out using other machining techniques. A variation of the machining technique used for the production of the blades shown in FIGS. 1 and 2 is illustrated diagrammatically in FIG. 7 where it will be seen that the scallops 12 on the one side of the blade extend in a straight line along the blade and run off the end of the blade as shown. The serrations on the other side of the blade will of course be as shown in FIG. 2 so that the blade will have a sharp edge along its entire length. The curved end portion of the blade will however be devoid of scallops, being provided only with fine serrations along its otherwise plain but curved distance. The blade need not necessarily have the outline shape of that of the illustrated embodiment. For example, the entire cutting edge could be straight or substantially straight (in the way in which the greater part of the cutting edge in the illustrated embodiment is straight).

What we claim and desire to secure by Letters Patent is:

1. A serrated-edge knife with a blade which has been made from a parallel-sided blade blank, the blank having been provided on one side with a plurality of scallops and on the other side thereof with a plurality of closely spaced serrations, the scallops intersecting the serrations at a cutting edge of the blade to produce a fine saw-like V-shaped cutting edge substantially centrally of the thickness of the blade.

2. A serrated-edge knife according to claim 1, having a handle and wherein the blade is curved at an end portion thereof remote from the handle.

3. A serrated-edge knife according to claim 2, in which the scallops on the one side of the blade extend at right angles from the cutting edge along the entire length of the blade.

4. A serrated-edge knife according to any one of the preceding claims, in which the included angle of the V-shaped cutting edge lies between 12 degrees and 30 degrees.

5. A serrated-edge knife according to any one of claims 1 to 3, in which the included angle of the V-shaped cutting edge lies between 16 degrees and 24 degrees.

6. A serrated-edge knife according to any one of claims 1 to 3, in which the included angle of the V-shaped cutting edge lies between 18 degrees and 22 degrees.

7. A serrated-edge knife according to any one of the preceding claims, in which the serrations are ground at a pitch between 0.6 mm and 1.2 mm.

8. A serrated-edge knife accordign to any one of claims 1 to 6, in which the serrations are ground at a pitch of 0.8 mm.

9. A serrated-edge knife according to any one of the preceding claims, in which the serrations each have an included angle of between 45 degrees and 75 degrees.

10. A serrated-edge knife according to any one of claims 1 to 8, in which the serrations each have an included angle of about 70 degrees.

* * * * *